US009222263B2

(12) United States Patent
Haddock

(10) Patent No.: US 9,222,263 B2
(45) Date of Patent: Dec. 29, 2015

(54) ROOF FRAMING STRUCTURE USING TRIANGULAR STRUCTURAL FRAMING

(71) Applicant: Robert M. M. Haddock, Colorado Springs, CO (US)

(72) Inventor: Robert M. M. Haddock, Colorado Springs, CO (US)

( * ) Notice: Subject to any disclaimer, the term of this patent is extended or adjusted under 35 U.S.C. 154(b) by 0 days.

(21) Appl. No.: 14/153,925

(22) Filed: Jan. 13, 2014

(65) Prior Publication Data

US 2014/0360119 A1 Dec. 11, 2014

Related U.S. Application Data

(63) Continuation of application No. 13/667,816, filed on Nov. 2, 2012, now Pat. No. 8,656,649, which is a continuation of application No. 12/542,132, filed on Aug. 17, 2009, now Pat. No. 8,312,678.

(60) Provisional application No. 61/228,125, filed on Jul. 23, 2009.

(51) Int. Cl.

| | |
|---|---|
| ***E04B 7/00*** | (2006.01) |
| ***E04C 3/02*** | (2006.01) |
| ***E04C 3/11*** | (2006.01) |
| ***E04D 12/00*** | (2006.01) |

(52) U.S. Cl.

CPC ..... *E04D 12/004* (2013.01); *E04D 12/002* (2013.01)

(58) Field of Classification Search

CPC ..... E04D 12/002; E04D 12/004
USPC ..... 52/90.1, 408, 474, 483.1, 528, 630, 101
See application file for complete search history.

(56) References Cited

U.S. PATENT DOCUMENTS

| | | | | | |
|---|---|---|---|---|---|
| 2,457,250 | A | * | 12/1948 | Macomber | 52/694 |
| 3,221,467 | A | * | 12/1965 | Henkels | 52/690 |
| 3,242,620 | A | * | 3/1966 | Kaiser | 52/73 |
| 3,496,691 | A | * | 2/1970 | Seaburg et al. | 52/336 |
| 3,753,326 | A | * | 8/1973 | Kaufman, Sr. | 52/845 |
| 3,792,560 | A | * | 2/1974 | Naylor | 52/364 |
| 3,824,664 | A | * | 7/1974 | Seeff | 428/604 |
| 4,001,474 | A | * | 1/1977 | Hereth | 428/116 |
| 4,007,574 | A | * | 2/1977 | Riddell | 52/302.3 |
| 4,051,289 | A | * | 9/1977 | Adamson | 428/113 |
| 4,223,053 | A | * | 9/1980 | Brogan | 428/34.5 |
| 4,686,809 | A | * | 8/1987 | Skelton | 52/528 |
| 4,909,011 | A | * | 3/1990 | Freeman et al. | 52/648.1 |
| 4,970,833 | A | * | 11/1990 | Porter | 52/93.1 |
| 5,118,571 | A | * | 6/1992 | Petersen | 428/586 |
| 5,119,612 | A | * | 6/1992 | Taylor et al. | 52/410 |
| 5,307,601 | A | * | 5/1994 | McCracken | 52/364 |

(Continued)

FOREIGN PATENT DOCUMENTS

| | | | | |
|---|---|---|---|---|
| FR | 2793827 | A1 | * | 11/2000 |
| GB | 2364077 | A | * | 1/2002 |

(Continued)

*Primary Examiner* — Rodney Mintz
(74) *Attorney, Agent, or Firm* — Marsh Fischmann & Breyfogle LLP

(57) ABSTRACT

A roof framing structure (20) is disclosed, and includes a plurality of primary supports (30) (e.g., rafters) that may be disposed in parallel relation and extend along the roof pitch (14). One or more secondary supports (40) extend between each adjacent pair of primary supports (30). Each secondary support (40) is of a triangular cross-sectional configuration, and may extend orthogonally to the various primary supports (30).

21 Claims, 5 Drawing Sheets

(56) References Cited

U.S. PATENT DOCUMENTS

| | | | | | |
|---|---|---|---|---|---|
| D347,701 | S | * | 6/1994 | McCracken | D25/126 |
| 5,356,519 | A | * | 10/1994 | Grabscheid et al. | 162/281 |
| 5,379,567 | A | * | 1/1995 | Vahey | 52/850 |
| 5,390,453 | A | * | 2/1995 | Untiedt | 52/90.1 |
| 5,417,028 | A | * | 5/1995 | Meyer | 52/846 |
| 5,426,906 | A | * | 6/1995 | McCracken | 52/650.1 |
| 5,483,782 | A | * | 1/1996 | Hall | 52/836 |
| 5,557,903 | A | * | 9/1996 | Haddock | 52/508 |
| 5,640,812 | A | * | 6/1997 | Crowley et al. | 52/90.1 |
| 5,660,008 | A | * | 8/1997 | Bevilacqua | 52/169.5 |
| 5,715,640 | A | * | 2/1998 | Haddock | 52/545 |
| 5,765,329 | A | * | 6/1998 | Huang | 52/302.3 |
| 5,826,379 | A | * | 10/1998 | Curry | 52/79.1 |
| 5,826,390 | A | * | 10/1998 | Sacks | 52/408 |
| 5,842,318 | A | * | 12/1998 | Bass et al. | 52/653.1 |
| 5,983,588 | A | * | 11/1999 | Haddock | 52/545 |
| 6,073,410 | A | * | 6/2000 | Schimpf et al. | 52/481.1 |
| 6,099,203 | A | * | 8/2000 | Landes | 404/10 |
| 6,164,033 | A | * | 12/2000 | Haddock | 52/545 |
| 6,237,297 | B1 | * | 5/2001 | Paroly | 52/652.1 |
| 6,364,374 | B1 | * | 4/2002 | Noone et al. | 285/424 |
| 6,393,796 | B1 | * | 5/2002 | Goettl et al. | 52/846 |
| 6,497,080 | B1 | * | 12/2002 | Malcolm | 52/846 |
| 6,655,633 | B1 | * | 12/2003 | Chapman, Jr. | 244/123.9 |
| D487,595 | S | * | 3/2004 | Sherman | D25/113 |
| 6,718,718 | B2 | * | 4/2004 | Haddock | 52/545 |
| D496,738 | S | * | 9/2004 | Sherman | D25/115 |
| 7,013,612 | B2 | * | 3/2006 | Haddock | 52/545 |
| 7,063,763 | B2 | * | 6/2006 | Chapman, Jr. | 156/175 |
| 7,100,338 | B2 | * | 9/2006 | Haddock | 52/545 |
| 7,451,573 | B2 | * | 11/2008 | Orszulak et al. | 52/167.1 |
| 7,469,511 | B2 | * | 12/2008 | Wobber | 52/474 |
| 7,493,730 | B2 | * | 2/2009 | Fennell, Jr. | 52/199 |
| 7,516,580 | B2 | * | 4/2009 | Fennell, Jr. | 52/199 |
| 7,707,800 | B2 | * | 5/2010 | Kannisto | 52/836 |
| 7,788,879 | B2 | * | 9/2010 | Brandes et al. | 52/838 |
| 7,861,480 | B2 | * | 1/2011 | Wendelburg et al. | 52/483.1 |
| 7,874,117 | B1 | * | 1/2011 | Simpson | 52/520 |
| 8,066,200 | B2 | * | 11/2011 | Hepner et al. | 238/2 |
| 8,096,503 | B2 | * | 1/2012 | Verweyen | 244/119 |
| 8,312,678 | B1 | * | 11/2012 | Haddock | 52/90.1 |
| 8,316,621 | B2 | * | 11/2012 | Safari Kermanshahi et al. | 52/837 |
| 8,347,572 | B2 | * | 1/2013 | Piedmont | 52/309.4 |
| 8,656,649 | B2 | * | 2/2014 | Haddock | 52/90.1 |
| 2002/0026765 | A1 | * | 3/2002 | Vahey | 52/732.1 |
| 2002/0108335 | A1 | * | 8/2002 | Haddock | 52/302.1 |
| 2003/0146346 | A1 | * | 8/2003 | Chapman, Jr. | 244/123 |
| 2003/0173460 | A1 | * | 9/2003 | Chapman, Jr. | 244/123 |
| 2004/0035065 | A1 | * | 2/2004 | Orszulak et al. | 52/167.1 |
| 2004/0237465 | A1 | * | 12/2004 | Refond | 52/783.11 |
| 2005/0210769 | A1 | * | 9/2005 | Harvey | 52/101 |
| 2006/0254192 | A1 | * | 11/2006 | Fennell | 52/699 |
| 2007/0289229 | A1 | * | 12/2007 | Aldo | 52/90.1 |
| 2007/0289233 | A1 | * | 12/2007 | Haddock | 52/309.4 |
| 2008/0041011 | A1 | * | 2/2008 | Kannisto | 52/726.2 |
| 2009/0007520 | A1 | * | 1/2009 | Navon | 52/837 |
| 2009/0230205 | A1 | * | 9/2009 | Hepner et al. | 238/2 |
| 2010/0206303 | A1 | * | 8/2010 | Thorne | 126/696 |
| 2012/0085041 | A1 | * | 4/2012 | Place | 52/173.3 |
| 2013/0152487 | A1 | * | 6/2013 | Haddock | 52/90.1 |

FOREIGN PATENT DOCUMENTS

| | | | | |
|---|---|---|---|---|
| GB | 2430946 | A | * | 4/2007 |
| JP | 2004092134 | A | * | 3/2004 |
| JP | 2004156326 | A | * | 6/2004 |
| JP | 2005171623 | A | * | 6/2005 |
| JP | 2011069130 | A | * | 4/2011 |
| WO | WO 2011011596 | A1 | * | 1/2011 |

* cited by examiner

ROOF FRAMING STRUCTURE USING TRIANGULAR STRUCTURAL FRAMING

CROSS-REFERENCE TO RELATED APPLICATIONS

This patent application is a continuation of U.S. patent application Ser. No. 13/667,816, filed Nov. 2, 2012, which is continuation of U.S. patent application Ser. No. 12/542,132, filed Aug. 17, 2009 (now U.S. Pat. No. 8,312,678, issued on Nov. 20, 2012), which is a non-provisional application of U.S. Provisional Patent Application Ser. No. 61/228,125, filed on Jul. 23, 2009. Priority is claimed to each application identified in this Cross-Reference to Related Applications section, and the entire disclosure of each such application is hereby incorporated by reference.

FIELD OF THE INVENTION

The present invention generally relates to roof framing structures, or structures that support a deck and/or panels of a roof, and, more particularly, to the configuration of structural framing used by structures of this type.

BACKGROUND

Roof framing structures for metal panel roofs typically entail having a plurality of main rafter beams extend along the pitch of the roof (e.g., the elevation of the main rafter beams changes proceeding along their respective length dimension). What is commonly referred to as "secondary framing" or "purlins" span between adjacent rafter beams. Common cross-sectional profiles for secondary framing include I-shaped, H-shaped, C-shaped, Z-shaped, tubular, open web or solid web joists and the like. Each of these configurations readily accommodates roosting by birds if they have access to the roof framing structure. Roof framing structures are accessible by birds in open-air structures such as carports, stadium roofs, and the like.

SUMMARY

A first aspect of the present invention is generally directed to a roofing section that includes a panel assembly and a roof framing structure. The panel assembly includes a plurality of panels, and is disposed in overlying relation to the roof framing structure. The roof framing structure includes a plurality of structural supports. Each of these structural supports has a length dimension (e.g., the structural supports may be characterized as elongated structures in their respective length dimension). At least some of these structural supports are of a triangular cross-sectional configuration taken perpendicularly to their corresponding length dimension. In one embodiment of the first aspect, the plurality of structural supports includes a plurality of primary supports and a plurality of secondary supports. The noted plurality of primary supports may collectively define a roof pitch—a length dimension of each primary support may extend in a direction of the roof pitch. Each of the noted secondary supports may extend between at least two primary supports in a direction that corresponds with a length dimension for the secondary supports.

A number of feature refinements and additional features are applicable to the first aspect of the present invention. These feature refinements and additional features may be used individually or in any combination. The following discussion is applicable to the first aspect, up to the start of the discussion of a second aspect of the present invention.

Each primary support may have a higher or larger load-bearing capacity than each secondary support, although such may not be required in each/all instances. In one embodiment, each primary support is longer than each secondary support. Other ways of distinguishing between "primary" and "secondary" in relation to the two "classes" of supports that may exist in the case of the roof framing structure used by the first aspect include without limitation: 1) each primary support may extend to and be mounted to a ridge beam, while none of the secondary beams engage such a ridge beam; 2) each secondary support may be parallel to a ridge beam to which the various primary supports are anchored; or 3) a combination thereof.

The primary supports may be characterized as those components of the roof framing structure that extend along a pitch of a roofing section that incorporates the roof framing structure. The pitch of the roofing section that incorporates the roof framing structure may be defined by the inclination of the various primary supports. Another characterization is that the elevation of the various primary supports may continually change proceeding along their respective length dimension and relative to an underlying, horizontally-disposed reference plane.

The secondary supports may extend orthogonally relative to the various primary supports. For instance, the length dimension of each secondary support may be disposed perpendicularly to the length dimension of each primary support. Another characterization is that the elevation of the various secondary supports may remain constant proceeding along their respective length dimension, where this elevation is measured relative to an underlying, horizontally-disposed reference plane.

The various primary supports may be disposed parallel to each other. The various secondary supports may be disposed parallel to each other. In the case where the various primary supports are disposed parallel to each other and where the various secondary supports are disposed parallel to each other, the various primary supports may be disposed in a different orientation than the various secondary supports (e.g., orthogonally).

Each primary support may be in the form of a beam, girder, rafter, frame, or open-web truss or the like. Representative materials from which each primary support may be formed include without limitation steel, timber, aluminum or other structural material. Representative materials from which each secondary support may be formed include without limitation steel, timber, aluminum or other structural material.

At least one secondary support may extend between each adjacent pair of primary supports in the roof framing structure. Multiple secondary supports may extend between each adjacent pair of primary supports in the roof framing structure. The space between each adjacent pair of primary supports may be characterized as a bay. Any appropriate number of secondary supports may be disposed in each individual bay, including where the same number of secondary supports are used in each bay or where the number of secondary supports used in one bay is different from the number of secondary supports used in at least one other bay. A secondary support in one bay may be axially aligned with a secondary support in one or both of the adjacent bays, may be axially offset with a secondary support in one or both of the adjacent bays, or a combination thereof. "Axially aligned" in relation to two different secondary supports means that the length dimension of these secondary supports is disposed along a common axis. "Axially offset" in relation to two different secondary supports means that the length dimension of a first secondary support is disposed along a first axis, and that the length dimension of a second secondary support is disposed along a second axis that is offset from (e.g., parallel) to the first axis.

Each structural member of the roof-framing structure that is of the triangular cross-section (e.g., a triangular structural support) may include a hollow interior. For instance, each such triangular structural support may include a closed perimeter, or a perimeter that extends a full 360° about a central, longitudinal reference axis coinciding with a length dimension of the triangular structural support. In one embodiment, a maximum wall thickness of each triangular structural support of such a hollow configuration is ⅜". Any appropriate triangular cross-sectional configuration may be utilized for the various triangular structural supports. For instance, a perimeter of the triangular structural supports each may be in the form of an equilateral triangle.

An uppermost surface of each secondary support of the roof framing structure may include a flat or planar section. Such a flat or planar section may define one of the sides of the noted triangular cross-sectional configuration. Although the other two sides of each secondary support may also be flat or planar, one or both of these sides could utilize a non-planar profile (e.g., a least slightly convex or concave relative to an exterior of the secondary support).

The various primary supports of the roof framing structure may each include a flat, uppermost surface. The various secondary supports may be incorporated by the roof framing structure such that they do not protrude beyond a first reference plane that contains the flat, uppermost surface of the primary supports. The various secondary supports may be incorporated by the roof framing structure such that a flat, uppermost surface of each such secondary support is also disposed within the noted first reference plane. The various secondary supports may be incorporated by the roof framing structure such that a flat, uppermost surface of each primary support and a flat, uppermost surface of each secondary support are co-planar. The flat, uppermost surface of each primary support, the flat, uppermost surface of each secondary support, or both, may engage or may be disposed in closely-spaced relation to an underside of the panel assembly (e.g., a corresponding flat portion of this underside), including where: 1) each secondary support is of the triangular cross-section, but none of the primary supports utilize such a triangular cross-section; 2) each primary support is of the triangular cross-section, but none of the secondary supports utilize such a triangular cross-section; or 3) each primary and secondary support is of the triangular cross-section. In at least certain instances, the roof framing structure may include a plurality of secondary supports disposed in parallel relation (e.g., where the ends of the secondary supports are supported by columns), but no primary supports.

Each secondary support may be directly attached or mounted to at least two adjacently-disposed primary supports. A butt joint may exist between each end of each secondary support and two adjacently disposed primary supports. Welding, bolting, threaded studs, riveting, screw-fastening or the like may be utilized to directly attach each secondary support to two or more primary supports.

Brackets may be used to interconnect the secondary supports with the primary supports. Each such bracket may be attached or mounted to a corresponding primary support in any appropriate manner (e.g., welding, one or more fasteners, bolts, rivets, studs or screws). Each such bracket may also include an appropriately-shaped receptacle (e.g., V-shaped) to receive a corresponding portion of a secondary support. In one embodiment, the brackets are attached or mounted to the sides of the primary supports, for instance such that each secondary support only extends between two adjacently-disposed primary supports (e.g., each bracket may support an end portion of a corresponding secondary support). In one embodiment, the brackets are attached or mounted to an uppermost surface of at least some of the primary supports, for instance such that the secondary supports are collectively disposed in overlying relation to the primary supports, such that each secondary support may extend between two or more primary supports, or both.

The plurality of secondary supports may be collectively positioned in overlying relation to the plurality of primary supports (e.g., such that the plurality of secondary supports are "above" the plurality of primary supports). The plurality of secondary supports may be incorporated by the roof framing structure so that an uppermost surface of each secondary support faces or projects away from a first reference plane that contains an uppermost surface of each of the primary supports. An uppermost surface of each primary support may be contained within a first reference plane, and an uppermost surface of each secondary support may be contained within a second reference plane, where the first and second reference planes are spaced apart and parallel to each other, and with the second reference plane being disposed at a higher elevation than the first reference plane (e.g., the second reference plane may be disposed in overlying relation to the first reference plane), including where: 1) each secondary support is of the triangular cross-section, but none of the primary supports utilize such a triangular cross-section; 2) each primary support is of the triangular cross-section, but none of the secondary supports utilize such a triangular cross-section; or 3) each primary and secondary support is of the triangular cross-section.

The roof framing structure that has been described in relation to the first aspect may be utilized by any appropriate roof. In one embodiment, a deck is positioned in overlying relation to the roof framing structure (e.g., such that a flat, uppermost surface of at least the various secondary supports engages a corresponding flat surface of an underside of the deck). In one embodiment, a panel assembly in the form of a plurality of panels is positioned in overlying relation to the roof framing structure (e.g., such that a flat, uppermost surface of at least the various secondary supports engages or is disposed in closely-spaced relation to a corresponding flat surface of an underside of the panel assembly). Any appropriate panel may be used by such a panel assembly, including metal panels, standing seam panels, and the like. Adjacent panels may be interconnected in any appropriate manner, may be disposed in overlapping relation, or both.

The roofing section that has been described in relation to the first aspect may be part of an open air structure, such as an outdoor sports stadium, a carport, or the like. As such, the above-described panel assembly includes an upper surface that is exposed to precipitation. The underside of the roofing section is then accessible by birds. Using structural members of a triangular cross-section limits the ability of birds to roost on the underside of the roofing section.

A second aspect of the present invention is generally directed to an open air structure that includes a roofing section, which in turn includes a roof framing structure. The roof framing structure includes a plurality of structural supports. Each of these structural supports has a length dimension (e.g., the structural supports may be characterized as elongated structures). At least some of these structural supports are of a triangular cross-sectional configuration taken perpendicularly to their corresponding length dimension. As the roofing section is part of an open air structure, the roof framing structure is directly exposed to an outdoor environment.

A number of feature refinements and additional features are applicable to the second aspect of the present invention. These feature refinements and additional features may be used individually or in any combination. The roof framing structure may be in accordance with the roof framing structure that was addressed in relation to the first aspect. In one embodiment, an overlying deck is engaged and/or supported by the roof framing structure. In another embodiment, an overlying panel assembly is engaged and/or supported by the roof framing structure. Such a panel assembly may be in accordance with the panel assembly that was addressed in relation to the first aspect.

A number of feature refinements and additional features are separately applicable to each of above-noted first and second aspects of the present invention as well. These feature refinements and additional features may be used individually or in any combination in relation to each of the first and second aspects. Instead of the roof framing structure of the first and second aspects using structural supports of a triangular cross-sectional configuration, the roof framing structure may utilize structural supports having a three-sided perimeter, where at least one of these sides includes a flat section (e.g., for interfacing with a corresponding flat portion on the underside of a deck or panel assembly). All three sides of any such structural support could include a flat section (e.g., so as to be of a triangular configuration), and the entirety of each such side could be flat (e.g., so as to be of a triangular configuration). As also noted above, the roof framing structure may not always use both primary and secondary supports. In this case, a plurality of structural supports for the roof framing structure may be disposed in parallel relation to each other, and these structural supports may have the triangular cross-sectional configuration (or the above-noted three-sided perimeter, with at least one side including a flat section) addressed herein.

Any feature of any other various aspects of the present invention that is intended to be limited to a "singular" context or the like will be clearly set forth herein by terms such as "only," "single," "limited to," or the like. Merely introducing a feature in accordance with commonly accepted antecedent basis practice does not limit the corresponding feature to the singular (e.g., indicating that a roof framing structure includes a "primary support" alone does not mean that the roof framing structure includes only a single "primary support"). Moreover, any failure to use phrases such as "at least one" also does not limit the corresponding feature to the singular (e.g., indicating that a roof framing structure includes "a primary support" versus "at least one primary support" alone does not mean that the roof framing structure includes only a single "primary support"). Use of the phrase "at least generally" or the like in relation to a particular feature encompasses the corresponding characteristic and insubstantial variations thereof (e.g., indicating that a secondary support is of an at least generally triangular cross-sectional configuration encompasses the secondary support being of a triangular cross-sectional configuration). Finally, a reference of a feature in conjunction with the phrase "in one embodiment" does limit the use of the feature to a single embodiment.

DETAILED DESCRIPTION

Figure 1:
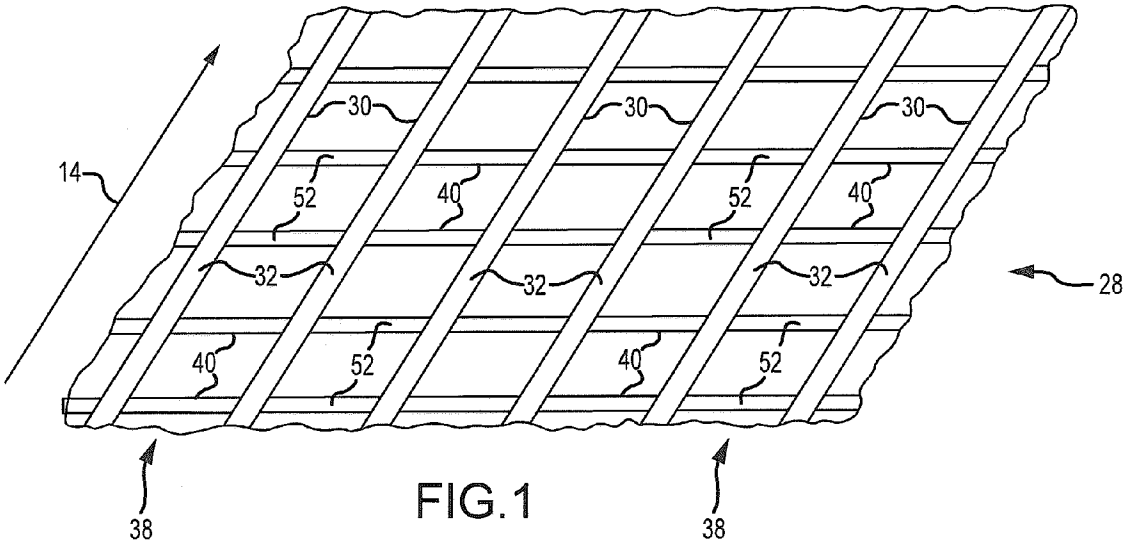
FIG. 1 is a perspective view of one embodiment of a roof framing structure, where the secondary supports are directly attached to corresponding primary supports.
Figure 2:
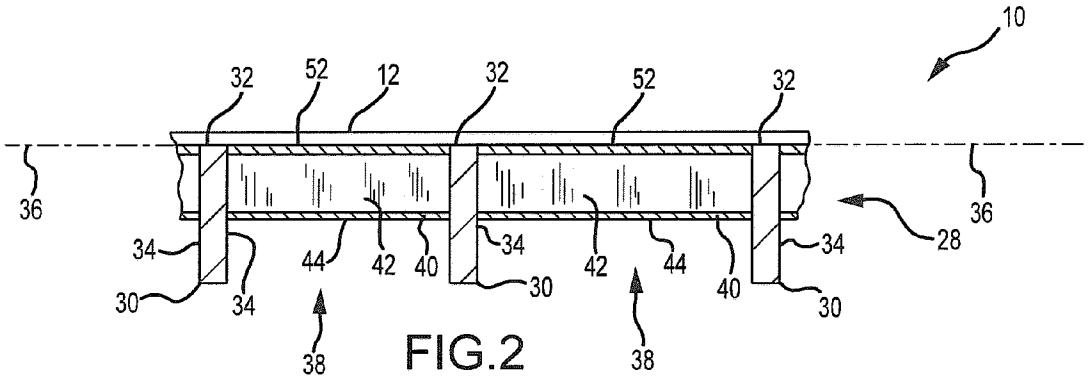
FIG. 2 is a cross-sectional view of a roofing section incorporating the roof framing structure of FIG. 1, taken perpendicularly to the pitch of the roofing section.

One embodiment of a roof framing structure is illustrated in FIGS. 1-2 and is identified by reference numeral 28. Such a roof framing structure 28 may define any appropriate portion of a roof (e.g., a roofing section). In any case, the roof framing structure 28 is defined by a plurality of primary supports 30, along with a plurality of secondary supports 40. Each primary support 30 may have a higher load-bearing capacity than each of the secondary supports 40, although such may not be required in all instances (e.g., the various primary supports 30 and the various secondary supports 40 could have the same load-bearing capacity).

The plurality of primary supports 30 of the roof framing structure 28 are disposed in parallel relation to each other, as are the plurality of secondary supports 40. However, the orientation of the plurality of primary supports 30 and the plurality of secondary supports 40 is different. Generally, a length dimension of the plurality of primary supports 30 coincides with (extends along) the roof pitch 14 (the arrowhead of the roof pitch 14 indicating the direction of increasing elevation in FIG. 1), while a length dimension of the plurality of secondary supports 40 is orthogonal or perpendicular to the length dimension of the plurality of primary supports 30 (and thereby perpendicular to the roof pitch 14). Another characterization is that the plurality of secondary supports 40 are horizontally disposed, while the plurality of primary supports 30 are orthogonal or perpendicular to the plurality of secondary supports 40. Yet another characterization is that the plurality of secondary supports 40 are parallel to a ridge beam (not shown) to which an end of each of the primary supports 30 is anchored.

The primary supports 30 may be in the form of beams, girders, rafters, frames, or open-web trusses or the like. Each primary support 30 may extend to and be mounted to a common ridge beam (not shown) at a location that will coincide with a peak of a roof incorporating the roof framing structure 28. Although the primary supports 30 are illustrated as having a rectangular cross-section in FIG. 2, other cross-sectional configurations may be appropriate (e.g., the cross-sectional configuration of the secondary supports 40 shown in FIG. 3 and discussed below, may be utilized by the primary supports 30). In any case, the spacing between each adjacent pair of primary supports 30 may be characterized as a bay 38. Although the primary supports 30 will typically be disposed in equally-spaced relation, such may not be required in all instances. Representative materials from which the various primary supports 30 may be formed include without limitation steel, timber, aluminum or other structural material.

In the illustrated embodiment, each primary support 30 includes a deck/panel interface surface 32, along with a pair of spaced side surfaces 34. The deck/panel interface surface 32 is intended to face or project upwardly when the primary support 30 is incorporated into the roof framing structure 28, and as such it may also be characterized as a flat, uppermost surface 32. In one embodiment, at least the deck/panel interface surface 32 of each primary support 30 is flat, although its corresponding side surfaces 34 may also be flat (or incorporate a flat portion) so as to be disposed in parallel relation to each other. The deck/panel interface surfaces 32 of the plurality of primary supports 30 are disposed in at least substantially co-planar relation.

At least one secondary support 40 extends between and is mounted to each adjacent pair of primary supports 30. In the illustrated embodiment, multiple secondary supports 40 extend between and are mounted to each adjacent pair of primary supports 30. Any appropriate spacing may be utilized between the secondary supports 40 in each bay 38 of the roof framing structure 28. Although the secondary supports 40 may be aligned from bay 38-to-bay 38 as shown in FIG. 1, at least some of the secondary supports 40 in one bay 38 may be staggered in relation to the secondary supports 40 in one or both of the adjacent bays 38 (not shown, but where the length dimension of a secondary support 40 in one bay 38 is not axially aligned with the length dimension of another secondary support 40 in one or both of the adjacent bays 38).

Figure 3:
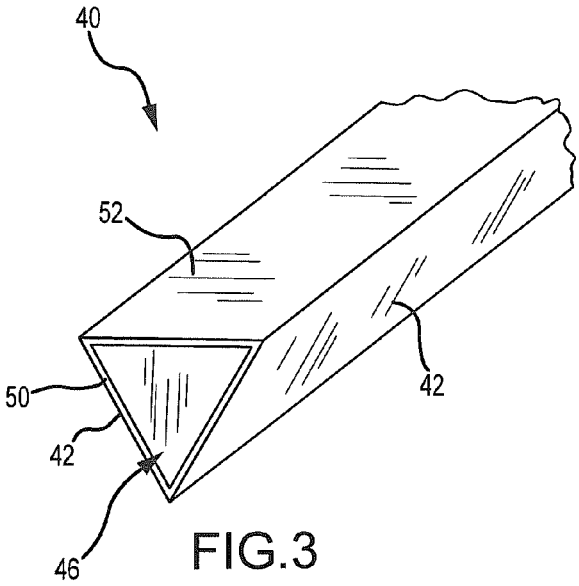
FIG. 3 is a perspective view illustrating the triangular configuration of the secondary supports used by the roof framing structure of FIG. 1.

A perspective view of one of the secondary supports 40 from the roof framing structure 28 of FIGS. 1-2 is presented in FIG. 3 (each of the secondary supports 40 being of a common configuration). Generally, the secondary support 40 includes a hollow interior 46 that is defined by a closed perimeter 50. "Closed" in this context means that the perimeter of the secondary support 40 extends a full 360° about a central reference axis that coincides with the length dimension of the secondary support 40. In any case, this closed perimeter 50 incorporates a deck/panel interface surface 52 that is flat. The deck/panel interface surface 52 is intended to face or project upwardly when the secondary support 40 is incorporated into the roof framing structure 28, and as such it may also be characterized as a flat, uppermost surface 52.

In the illustrated embodiment, the secondary supports 40 are of a triangular cross-sectional profile or configuration taken perpendicularly to their corresponding length dimension. As such, the closed perimeter 50 of each secondary support 40 further includes a pair of sides 42 that may each be in the form of a flat surface. The two sides 42 intersect at an apex or corner 44, and each side 42 also intersects with the deck/panel interface surface 52 to define a corresponding apex or corner 44 (the corners 44 may be rounded (or of any other appropriate shape), versus as shown). In one embodiment, the two sides 42 and the deck/panel interface surface 52 of each secondary support 40 are of all the same size, such that the cross-sectional profile of each secondary support 40 may be in the form of an equilateral triangle. Other triangular cross-sectional configurations may be appropriate for the secondary supports 40 as well. Moreover, one or both of the sides 42 of each secondary support 40 could be slightly curved (convex or concave, relative to an exterior of the secondary support 40) versus flat as shown in FIG. 3.

The secondary supports 40 (or any primary support 30 of a similar profile) may also be characterized as having a three-sided perimeter (e.g., the two sides 42, along with the deck/panel interface surface 52). At least one of these sides may include a flat section (e.g., for interfacing with a corresponding flat portion of an underside of a deck/panel assembly 12, shown in FIG. 2 and discussed below). The entirety of a given side may be flat or planar (e.g., in accordance with the illustrated embodiment).

Representative materials from which the various secondary supports 40 may be formed include without limitation steel, timber, aluminum or other structural material. Although the secondary supports 40 may be fabricated in any appropriate manner, in one embodiment a plate or sheet of a metal/alloy is roll formed into a round tube and its two long edges are then fused together in any appropriate manner. The round tube may then be roll-formed into the above-noted triangular shape (e.g., by cold rolling). Another option would be to roll-form the triangular shape and to continuously weld the seam (from flat sheet or plate material) after the shape is formed (or in tandem). In one embodiment, a maximum wall thickness of each secondary support 40 is ⅜".

The roof framing structure 28 of FIGS. 1-2 is configured such that each secondary support 40 extends between the side surface 34 of an adjacent pair of primary supports 30. In this case, the two ends of each secondary support 40 may be directly attached to the adjacently disposed side surface 34 of a primary support 30 in any appropriate manner (e.g., welding, bolting, threaded studs, riveting, screw-fastening). For instance, a butt joint may exist between each end of each secondary support 40 and a side surface 34 of its corresponding primary support 30 (e.g., each secondary support 40 may be in the form of a simply supported beam).

Each secondary support 40 of the roof framing structure 28 is oriented such that its deck/panel interface surface 52 is disposed in at least substantially co-planar relation with deck/panel interface surface 32 of each of the primary supports 30 in the FIG. 2 configuration. A first reference plane 36 may be characterized as containing the deck/panel interface surface 32 of each primary support 30, along with the deck/panel interface surface 52 of each secondary support 40. Another characterization is that no portion of any of the secondary supports 40 protrudes above this first reference plane 36. In any case, a deck or panel assembly 12 (e.g., sheets of plywood to define a deck; a plurality of panels (e.g., metal panels) that define a panel assembly) may be disposed on (or in closely-spaced relation to) the roof framing structure 28 and engage and/or be supported by the deck/panel interface surface 32 of each primary support 30, along with the deck/panel interface surface 52 of each secondary support 40. In one embodiment, the deck/panel interface surface 32 of each primary support 30, along with the deck/panel interface surface 52 of each secondary support 40 engages (or is disposed in closely-spaced relation to) the underside of the deck/panel assembly 12 (e.g., a corresponding flat surface on this underside). In any case, the roof framing structure 28 and the deck/panel assembly 12 may be characterized as defining a roofing section 10 for any appropriate structure (e.g., a car port, a stadium cover, canopy or any other structure where bird roosting may be a nuisance). The roofing section 10 may define any appropriate portion of a roof.

Figure 4A:
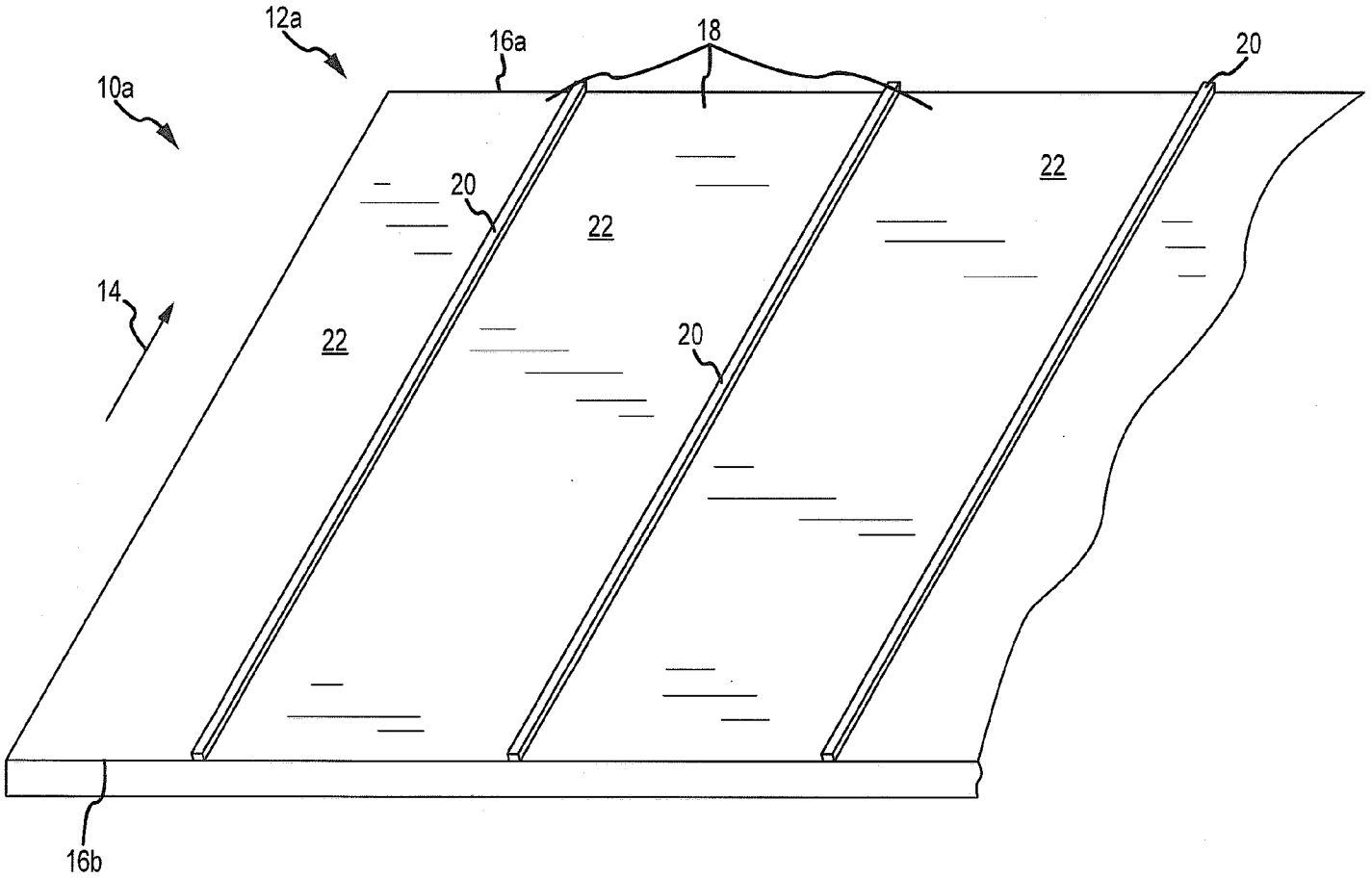
FIG. 4A is a perspective view of a representative roofing section defined by a panel assembly that may be supported by the roof framing structure of FIGS. 1, 5A-5B, and 6.
Figure 4B:
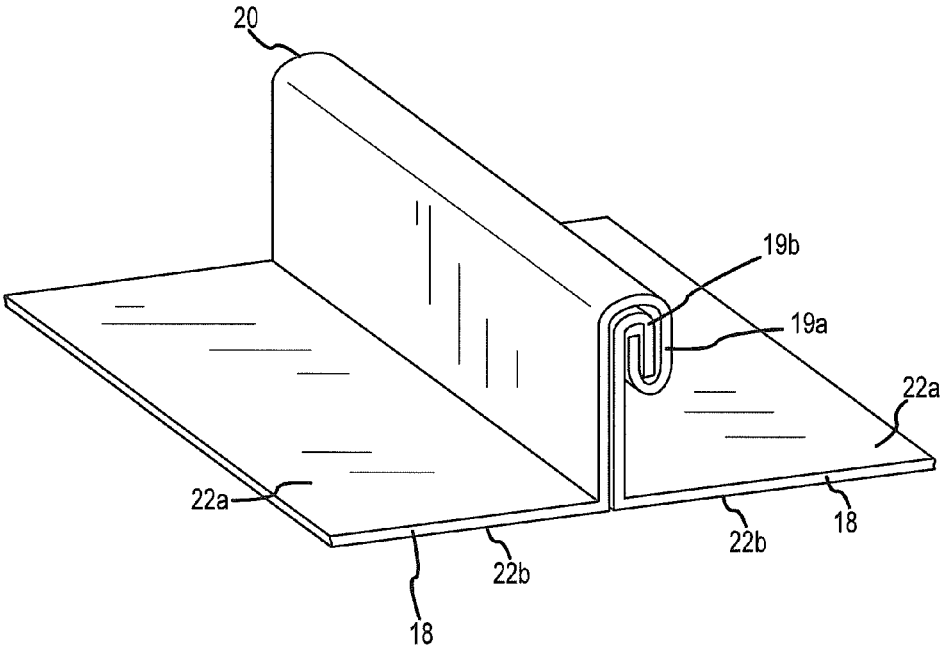
FIG. 4B is an enlarged perspective view of a representative configuration for a standing seam from the panel assembly of FIG. 4A.

A representative configuration of a panel assembly that may be supported by the roof framing structure 28 (as well as the roof framing structures 28' and 28" that will be discussed below) is shown in FIGS. 4A and 4B, and is identified by reference numeral 12*a*. The panel assembly 12*a* and the roof framing structure 28 may be characterized as being part of a roofing section 10*a*. The roofing section 10*a* may utilize a roof pitch 14 of any appropriate magnitude (the arrowhead of the roof pitch 14 again indicating the direction of increasing elevation in FIG. 4A). The roof pitch 14 in FIG. 4A may be characterized as extending from an edge 16*b* of the roofing section 10*a* to a peak 16*a* of the roofing section 10*a*.

Multiple panels 18 (e.g., metal panels) collectively define the panel assembly 12*a*. The interconnection of each adjacent pair of panels 18 in the illustrated embodiment defines a standing seam 20 (only schematically illustrated in FIG. 4A). The standing seams 20 may at least generally proceed in the direction of or along the slope or roof pitch 14 of the roofing section 10*a* (e.g., the pitch of the length dimension of the standing seams 20 may match the roof pitch 14 of the corresponding portion of the roofing section 10*a*). Each panel 18 includes at least one base section 22 that is at least generally flat or planar and that is disposed between each adjacent pair of standing seams 20 on the roofing section 12*a*. Both an upper surface 22*a* and a lower surface 22*b* of each base section 22 may be flat or planar (FIG. 4B). At least substantially an entirety of the underside of the panel assembly 12*a* may be characterized as a flat surface. As such, an uppermost flat portion of the roof framing structure 28 (e.g., the deck/panel interface surface 52 of the secondary supports 40 and/or the deck/panel interface surface 32 of the primary supports 30) may engage (or may be disposed in closely-spaced relation to) a corresponding flat surface on the underside of the panel assembly 12*a* (e.g., part of the lower surface 22*b*).

The panels 18 may be of any appropriate configuration so to allow them to be interconnected or nested in a manner that defines a standing seam 20, and the standing seams 20 may be disposed in any appropriate orientation relative to the base sections 22 of the panels 18 that define the standing seam 20. Generally, the standing seams 20 may be characterized as at least initially extending orthogonally (e.g., perpendicularly) relative to the base sections 22 of the corresponding panels 18. The illustrated standing seams 20 may be characterized as having a vertical end section, or as being of a vertical standing seam configuration. However, the end sections of the various standing seams 20 could also have portions that are horizontally disposed (e.g., at least generally parallel with the base sections 22 of the corresponding panels 18), or as being of a horizontal standing seam configuration.

FIG. 4B illustrates a perspective view of a representative configuration for a standing seam 20 that may be used by the panel assembly 12*a* of FIG. 4A. There it can be seen that a pair of panels 18 are interconnected so as to collectively define a standing seam 20. Generally, a longitudinal edge section 19*a* of one panel 18 (e.g., the right edge section of the left panel 18 in the view shown in FIG. 4B) is "nested" with the opposing longitudinal edge section 19*b* of an adjacent panel 18 (e.g., the left edge section of the right panel 18 in the view shown in FIG. 4B) to collectively define the standing seam 20. This is commonly referred to as a "double folded seam" configuration. Other configurations for the "nested" longitudinal edges of the panels 18 may be utilized to provide a different configuration that still defines a standing seam 20.

Figure 5A:
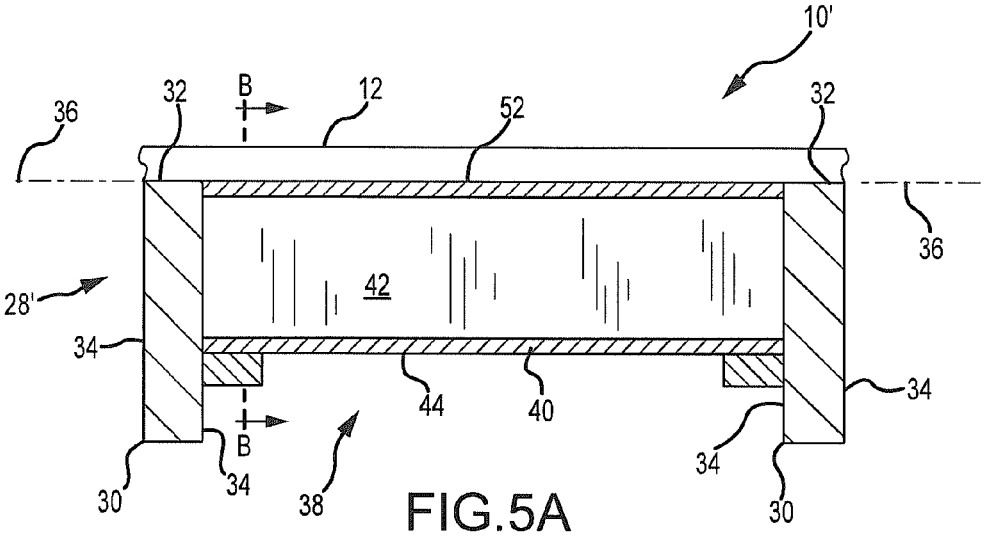
FIG. 5A is a cross-sectional view of a roofing section incorporating a variation of the roof framing structure of FIG. 1, taken perpendicularly to the pitch of the roofing section, and where brackets are utilized to maintain the deck/panel interface surfaces of the various primary and secondary supports in coplanar relation.
Figure 5B:
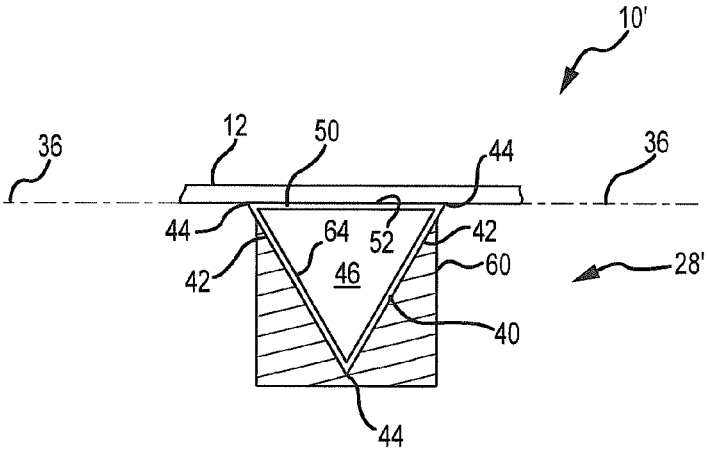
FIG. 5B is a cross-sectional view taken along line B-B in FIG. 5A.

Another way of incorporating the plurality of secondary supports 40 into a roof framing structure is shown in FIGS. 5A and 5B, and is indentified by reference numeral 28'. Corresponding components between the embodiment of FIGS. 1-2 and the embodiment of FIGS. 5A-5B are identified by the same reference numeral, and unless otherwise noted herein the discussion presented above remains equally applicable. Those corresponding components that differ in at least some respect are identified by a "single prime" designation in the embodiment of FIGS. 5A-B. Generally, the roof framing structure 28' from FIGS. 5A-B utilizes additional components compared to the roof framing structure 28 of FIGS. 1-2.

The roofing section 10' shown in FIGS. 5A and 5B (a single prime designation being used in relation to the roofing section 10', as at least one component thereof (e.g., the roof framing structure 28') differs from the roofing section 10 of FIG. 2) still has the deck/panel interface surface 32 of each primary support 30 and the deck/panel interface surface 52 of each secondary support 40 disposed within the first reference plane 36 (e.g., for collectively engaging or being disposed in closely-spaced relation to a flat surface on an underside of the deck/panel assembly 12). However, instead of the various secondary supports 40 being directly attached to an adjacent pair of primary supports 30, brackets 60 are utilized. The brackets 60 may be characterized as providing an interface between the secondary supports 40 and primary supports 30. Another characterization is that the brackets 60 support the corresponding secondary support 40 from its two corresponding primary supports 30.

The brackets 60 may be mounted to the primary supports 30 in any appropriate manner (e.g., using one or more fasteners, welding, bolting, threaded studs, riveting, screw-fastening). Each bracket 60 receives an end portion of a corresponding secondary support 40. In this regard, each bracket 60 includes a receptacle 64 into which an end portion of a secondary support 40 may be disposed. Opposing end portions of each secondary support 40 are thereby disposed within the receptacles 64 of two brackets 60 that are mounted to an adjacent pair of primary supports 30 (one bracket 60 on each such primary support 30). As the secondary supports 40 utilize the above-noted triangular cross-sectional profile, the receptacle 64 of each bracket 60 may be V-shaped (e.g., so that an individual bracket 60 supports/interfaces with at least part of each of the two sides 42 of the corresponding secondary support 40, and including supporting/interfacing with the entirety of each side 42—not shown). The V-shaped configuration of the receptacle 64 of the brackets 60 also restrains/limits motion of the secondary supports 40 relative to the corresponding primary supports 30 within the first reference plane 36 and orthogonally to the length dimension of the secondary supports 40. Other configurations for the brackets 60 may be appropriate.

Figure 6:
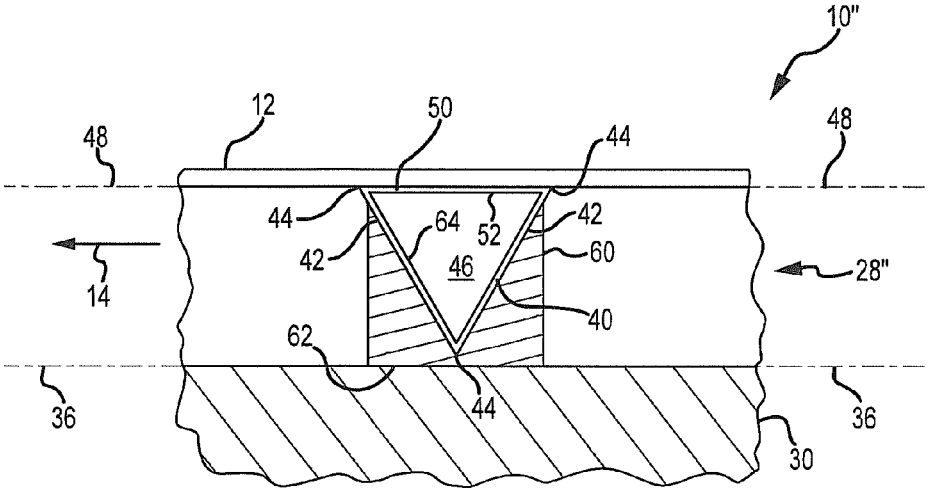
FIG. 6 is a cross-sectional view of a roofing section incorporating another variation of the roof framing structure of FIG. 1, taken perpendicularly to the pitch of the roofing section, and where brackets are utilized to dispose the deck/panel interface surfaces of the various primary and secondary supports in vertically offset relation.

Another way of incorporating the plurality of secondary supports 40 into a roof framing structure is shown in FIG. 6 and is indentified by reference numeral 28". Corresponding components between the embodiment of FIGS. 5A-B (as well as the embodiment of FIGS. 1-2) and the embodiment of FIG. 6 are identified by the same reference numeral, and unless otherwise noted herein the discussion presented above remains equally applicable. Those corresponding components that differ in at least some respect are identified by a "double prime" designation in the embodiment of FIG. 6. Generally, the roof framing structure 28" from FIG. 6 utilizes a different arrangement of the brackets 60 compared to the roof framing structure 28' of FIGS. 5A-B. As such, the roofing section 10" (which includes the roof framing structure 28" as part thereof), is also identified by a "double prime" designation.

One distinction between the roof framing structure 28' of FIGS. 5A-B (as well as the roof framing structure 28 of FIGS. 1-2) and the roof framing structure 28" of FIG. 6 is the manner in which the secondary supports 40 are integrated. In the case of the roof framing structure 28" of FIG. 6, the plurality of secondary supports 40 may be characterized as being collectively disposed in overlying relation to the plurality of primary supports 30. For instance, the deck/panel interface surface 52 of each of the secondary supports 40 may be disposed within a second reference plane 48 that is disposed in overlying relation (e.g., "above") to the first reference plane 36 that now only includes the deck/panel interface surface 32 of the primary supports 30. The second reference plane 48 may also be parallel to the first reference plane 36. One way in which this overlying configuration of the plurality of secondary supports 40 may be realized in relation to the plurality of primary supports 30, is to use an appropriate bracket. In any case, the deck/panel interface surface 52 of each of the secondary supports 40 may engage a flat surface on the underside of the deck/panel assembly 12.

In the FIG. 6 configuration, a secondary support 40 may be supported by an underlying primary support 30 by a bracket 60 that is attached to the deck/panel interface surface 32 of the underlying primary support 30. The bracket 60 may include a base 62 (e.g., a flat surface) that may be positioned on the deck/panel interface surface 32 (e.g., an upwardly facing flat surface) of a primary support 30. Again, each bracket 60 may be mounted to a corresponding primary support 30 in any appropriate manner (e.g., one or more fasteners, welding, bolting, threaded studs, riveting, screw-fastening). Generally, each secondary support 40 is disposed in the receptacle 64 of at least two different brackets 60 that are mounted on different primary supports 30. A bracket 60 may be disposed between a given secondary support 40 and each underlying primary support 30. Although a secondary support 40 could have a length dimension so as to only extend between adjacent pairs of primary supports 30 in the FIG. 6 configuration, a secondary support 40 could be disposed in overlying relation to three or more primary supports 30 as well (e.g., where the secondary support 40 is supported by at least two primary supports 30 via an intermediate bracket 60, and including by each underlying primary support 30 via an intermediate bracket 60).

The roof framing structures 28/28'/28" may be used for any appropriate application. However, the roof framing structures 28/28'/28" may be particularly suited for open-air structures such as car ports, stadium roofing, canopies, or open storage covers. One benefit of the roof framing structures 28/28'/28" for these types of applications is that the triangular cross-sectional configuration of the primary and/or secondary supports 30, 40 does not provide a suitable roost for birds. In an open-air structure, the deck/panel assembly 12 may be directly exposed to precipitation, the outdoor environment, and the like (e.g., the panel assembly 12*a*). Moreover, the roof framing structure 28/28'/28" will likewise be exposed to the outdoor environment, and thus accessible by birds and the like.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed:

1. A roofing section, comprising:

a roof framing structure comprising a plurality of structural supports, wherein said plurality of structural supports comprises:

a plurality of primary supports; and a plurality of secondary supports formed from a material selected from the group consisting of a metal and an alloy, wherein each of said plurality of secondary supports comprises a hollow interior, a length dimension that extends in a different direction than a length dimension of said plurality of primary supports, and a closed perimeter comprising first, second, and third sides, wherein said first side of each said secondary support is flat and defines an uppermost surface of said secondary support, wherein said first, second, and third sides of each said secondary support collectively define a triangular cross-sectional configuration that is taken perpendicularly to said length dimension of said secondary support, wherein said plurality of secondary supports are collectively positioned in overlying relation to said plurality of primary supports, wherein a flat, uppermost surface of each of said plurality of primary supports is contained within a first reference plane, and wherein said first side of each of said plurality of secondary supports is contained within a second reference plane that is spaced above and parallel to said first reference plane;

a plurality of brackets, wherein each bracket of said plurality of brackets provides an interconnection between one said primary support and one said secondary support, wherein each said bracket is positioned on said flat, uppermost surface of a corresponding said primary support, wherein a V-shaped receptacle of each said bracket projects away from a respective said corresponding said primary support, and wherein a single corresponding said secondary support is received in said V-shaped receptacle of each said bracket; and a panel system disposed in overlying relation to said roof framing structure and comprising a plurality of panels, wherein said first side of each said secondary support is in a relative position to said panel system that is selected from the group consisting of engaging a corresponding flat portion of an underside of said panel system or disposed in closely-spaced relation to said corresponding flat portion of said underside of said panel system, and wherein no portion of said roof framing structure is closer to said underside of said panel system than said first side of said plurality of secondary supports;

wherein said V-shaped receptacle of each said bracket also projects in a direction of said underside of said panel system.

2. The roofing section of claim 1, wherein each said secondary support comprises a maximum wall thickness of ⅜".

3. The roofing section of claim 1, wherein said triangular cross-sectional configuration for each said secondary support comprises an equilateral triangle.

4. The roofing section of claim 1, wherein said plurality of primary supports are disposed in parallel relation to each other, and wherein said plurality of secondary supports are disposed in parallel relation to each other in a different orientation than said plurality of primary supports.

5. The roofing section of claim 1, wherein said length dimension of each of said plurality of primary supports extends in a direction of a roof pitch.

6. The roofing section of claim 1, wherein said V-shaped receptacle of each said bracket projects in an upward direction.

7. The roofing section of claim 1, wherein each said bracket is mounted to a corresponding said primary support.

8. The roofing section of claim 1, wherein each said bracket is disposed between a corresponding said primary support and a corresponding said secondary support.

9. The roofing section of claim 1, wherein each said primary support has a larger load-bearing capacity than each said secondary support.

10. The roofing section of claim 1, wherein an elevation of each said primary support continually changes proceeding along said length dimension of the corresponding said primary support, and wherein an elevation of each said secondary support remains constant proceeding along said length dimension of the corresponding said secondary support.

11. The roofing section of claim 10, wherein said plurality of primary supports are disposed in parallel relation to each other, and wherein said plurality of secondary supports are disposed in parallel relation to each other in a different orientation than said plurality of primary supports.

12. A roofing section, comprising:

a roof framing structure comprising a plurality of structural supports, wherein said plurality of structural supports comprises:

a plurality of primary supports; and a plurality of secondary supports, wherein each said secondary support comprises a maximum wall thickness of ⅜", wherein each of said plurality of secondary supports comprises a hollow interior, a length dimension that extends in a different direction than a length dimension of said plurality of primary supports, and a closed perimeter comprising first, second, and third sides, wherein said first side of each said secondary support is flat and defines an uppermost surface of said secondary support, wherein said first, second, and third sides of each said secondary support collectively define a triangular cross-sectional configuration that is taken perpendicularly to said length dimension of said secondary support, wherein said plurality of secondary supports are collectively positioned in overlying relation to said plurality of primary supports, wherein a flat, uppermost surface of each of said plurality of primary supports is contained within a first reference plane, and wherein said first side of each of said plurality of secondary supports is contained within a second reference plane that is spaced above and parallel to said first reference plane;

a plurality of brackets, wherein each said bracket provides an interconnection between one said primary support and one said secondary support, wherein each said bracket comprises a V-shaped receptacle for receipt of a corresponding said secondary support, and wherein each said bracket is positioned on said flat, uppermost surface of a corresponding said primary support; and a panel system disposed in overlying relation to said roof framing structure and comprising a plurality of panels, wherein said first side of each said secondary support is in a relative position to said panel system that is selected from the group consisting of engaging a corresponding flat portion of an underside of said panel system or disposed in closely-spaced relation to said corresponding flat portion of said underside of said panel system, and wherein no portion of said roof framing structure is closer to said underside of said panel system than said first side of said plurality of secondary supports.

13. The roofing section of claim 12, wherein said triangular cross-sectional configuration for each said secondary support comprises an equilateral triangle.

14. The roofing section of claim 12, wherein said plurality of primary supports are disposed in parallel relation to each other, and wherein said plurality of secondary supports are disposed in parallel relation to each other in a different orientation than said plurality of primary supports.

15. The roofing section of claim 12, wherein said length dimension of each of said plurality of primary supports extends in a direction of a roof pitch.

16. The roofing section of claim 12, wherein said V-shaped receptacle of each said bracket projects in an upward direction for receipt of the corresponding said secondary support.

17. The roofing section of claim 12, wherein each said bracket is mounted to a corresponding said primary support.

18. The roofing section of claim 12, wherein each said bracket is disposed between a corresponding said primary support and a corresponding said secondary support.

19. The roofing section of claim 12, wherein each said primary support has a larger load-bearing capacity than each said secondary support.

20. The roofing section of claim 12, wherein an elevation of each said primary support continually changes proceeding along said length dimension of the corresponding said primary support, and wherein an elevation of each said secondary support remains constant proceeding along said length dimension of the corresponding said secondary support.

21. The roofing section of claim 20, wherein said plurality of primary supports are disposed in parallel relation to each other, and wherein said plurality of secondary supports are disposed in parallel relation to each other in a different orientation than said plurality of primary supports.

* * * * *